US012546040B2

(12) United States Patent
Fraser

(10) Patent No.: US 12,546,040 B2
(45) Date of Patent: Feb. 10, 2026

(54) FEED DOG COVER

(71) Applicant: Gracewood Management, Inc., West Jordan, UT (US)

(72) Inventor: Craig Fraser, West Jordan, UT (US)

(73) Assignee: GRACEWOOD MANAGEMENT, INC., West Jordan, UT (US)

( * ) Notice: Subject to any disclaimer, the term of this patent is extended or adjusted under 35 U.S.C. 154(b) by 0 days.

(21) Appl. No.: 18/904,630

(22) Filed: Oct. 2, 2024

(65) Prior Publication Data

US 2025/0116043 A1 Apr. 10, 2025

Related U.S. Application Data

(60) Provisional application No. 63/588,514, filed on Oct. 6, 2023.

(51) Int. Cl.

| | |
|---|---|
| ***D05B 19/16*** | (2006.01) |
| ***D05B 11/00*** | (2006.01) |
| ***D05B 27/02*** | (2006.01) |
| ***D05B 73/10*** | (2006.01) |

(52) U.S. Cl.

CPC ..... *D05B 73/10* (2013.01); *D05B 11/00* (2013.01); *D05B 19/16* (2013.01); *D05B 27/02* (2013.01)

(58) Field of Classification Search

CPC ..... D05B 19/16; D05B 27/24; D05B 73/10; D05B 73/06; D05B 11/00; D05B 27/02

See application file for complete search history.

(56) References Cited

U.S. PATENT DOCUMENTS

| | | | | |
|---|---|---|---|---|
| 3,188,993 | A * | 6/1965 | Szuba | D05B 77/00 112/258 |
| 4,114,548 | A * | 9/1978 | Kasahara | D05B 77/00 112/258 |
| 5,476,052 | A * | 12/1995 | Kojima | D05B 73/04 292/87 |
| 5,906,168 | A * | 5/1999 | Ito | D05B 77/00 D15/75 |
| 6,019,052 | A * | 2/2000 | Stucki | D05B 73/04 112/102.5 |
| 6,293,212 | B1 * | 9/2001 | Ebata | D05B 21/00 112/168 |
| 8,661,996 | B2 * | 3/2014 | Inoue | D05B 91/12 112/260 |
| 9,903,056 | B2 | 2/2018 | Koike et al. | |
| 11,098,424 | B2 | 8/2021 | Azuma | |
| 11,274,386 | B2 | 3/2022 | Takei | |
| 11,377,767 | B2 | 7/2022 | Ishikawa et al. | |
| 2006/0219140 | A1 * | 10/2006 | Fukao | D05B 73/10 112/470.14 |
| 2019/0292701 | A1 * | 9/2019 | Shiraishi | D05B 29/12 |

* cited by examiner

*Primary Examiner* — Danny Worrell
(74) *Attorney, Agent, or Firm* — Ryan L. Marshall; Jessica Kiser; Barnes & Thornburg LLP

(57) ABSTRACT

A sewing machine assembly includes a sewing machine frame, a presser bar mounted to a frame head of the sewing machine frame, and a feed dog assembly. The feed dog assembly includes a feed dog mounted to the frame base to reciprocate vertically and horizontally relative to the frame base to pull fabric between the pressure bar and the frame base through the sewing machine frame, a feed dog drive system coupled to the feed dog to drive reciprocation of the feed dog relative to the frame base, and a feed dog cover selectively coupled to a frame base of the sewing machine frame to extend over the feed dog to shield the fabric from the feed dog.

20 Claims, 12 Drawing Sheets

FEED DOG COVER

CROSS-REFERENCE TO RELATED APPLICATIONS

This application claims the benefit of U.S. Provisional Application No. 63/588,514, filed Oct. 6, 2023; the entire contents of this application is hereby incorporated by reference herein.

FIELD OF DISCLOSURE

The present disclosure relates generally to sewing or quilting machines, and more specifically to attachments for sewing or quilting machines.

BACKGROUND

Sewing machines are used for stitching one or more pieces of fabric with thread. Some sewing machines are stationary such that fabric is fed under a needle of the sewing machine, while other sewing machines, like quilting machines, are maneuverable such that the needle may be moved across the fabric.

Maneuverable sewing machines allow a user to create intricate patterns with the stitching. Such sewing or quilting machines, however, may also make it difficult to accurately follow a path on the fabric, such as a seam, a ditch line, or another desired pattern.

SUMMARY

The present disclosure may comprise one or more of the following features and combinations thereof.

A sewing machine assembly may include a sewing machine frame, a presser bar, a feed dog assembly, and a control unit. The sewing machine frame may include a frame base, a frame body that extends from the frame base, a frame head coupled to the frame body that extends from the frame body toward the frame base to define a throat of the sewing machine frame. The presser bar may be mounted to the frame head that extends from the frame head toward the frame base. The control unit may be coupled to the feed dog assembly.

In some embodiments, the feed dog assembly may include a feed dog, a feed dog drive system, and a feed dog cover. The feed dog may be mounted to the frame base to reciprocate vertically and horizontally relative to the frame base to pull fabric between the pressure bar and the frame base through the sewing machine frame. The feed dog drive system may be coupled to the feed dog and may be configured to drive reciprocation of the feed dog relative to the frame base. The feed dog cover may be configured to selectively change between a disengaged position in which the feed dog cover is spaced apart from the frame base to expose the feed dog to the fabric and an engaged position in which the feed dog cover extends over the feed dog to shield the fabric from the feed dog.

In some embodiments, the control unit may be coupled to the feed dog drive system and may be configured to direct the feed dog drive system to decrease a speed of the reciprocation of the feed dog when the feed dog cover is changed from the disengaged position to the engaged position. The control unit may direct the feed dog drive system to decrease the speed of the reciprocation of the feed dog when the feed dog cover is changed from the disengaged position to the engaged position so that the sewing machine assembly changes from a fixed motion mode to a free motion mode to allow a user to freely maneuver one of the sewing machine assembly and the fabric relative to the other.

In some embodiments, the control unit may include a sensor and a controller coupled to the sensor. The sensor may be coupled to the frame base and may be configured to detect when the feed dog cover is in the engaged position. The controller may be configured to receive a signal from the sensor indicative of the feed dog cover being in the engaged position and direct the feed dog drive system to decrease the speed of the reciprocation of the feed dog in response to the signal.

In some embodiments, the sensor may be a manual button. The manual button may be configured to change between a first position associated with the fixed motion mode of the sewing machine assembly and a second position associated with the free motion mode of the sewing machine assembly. In some embodiments, the sensor may be an optical sensor.

In some embodiments, the feed dog cover may include a cover plate and a sensor tab. The cover plate may have a first side, a second side opposite the first side, and an outer edge that extends between and interconnects the first and second sides. The sensor tab may extend from the first side of the cover plate so as to engage the manual button when the feed dog cover is in the engaged position to change the manual button from the first position to the second position.

In some embodiments, the feed dog cover may further include a pair of locator tabs. The pair of locator tabs may extend from the first side of the cover plate. The pair of locator tabs may be configured to be received in locator notches on the frame base when the feed dog cover is in the engaged position so as to align the sensor tab with the manual button.

In some embodiments, the feed dog cover may further include at least one magnet coupled to the cover plate. The at least one magnet may be configured to apply a magnetic force to the frame base to draw the cover plate to the frame base so that the feed dog cover remains coupled to the frame base when the feed dog cover is in the engaged position.

In some embodiments, the feed dog cover may a cover plate and at least one locator tab. The cover plate may have a first side, a second side opposite the first side, and an outer edge that extends between and interconnects the first and second sides. The at least one locator tab may extend from the first side of the cover plate. The at least one locator tab may be configured to be received in a locator notch on the frame base when the feed dog cover is in the engaged position.

In some embodiments, the feed dog cover may further include at least one magnet coupled to the cover plate. The at least one magnet may be configured to apply a magnetic force to the frame base to draw the cover plate to the frame base so that the feed dog cover remains coupled to the frame base when the feed dog cover is in the engaged position.

In some embodiments, the cover plate of the feed dog cover may be formed to include a cavity. The cavity may extend into the first side of the cover plate. The cavity may receive the feed dog when the feed dog cover is in the engaged position.

In some embodiments, the control unit may be configured to direct the feed dog drive system to lower a peak vertical position of the feed dog as the feed dog reciprocates vertically and horizontally relative to the sewing machine frame when the feed dog cover is changed from the disengaged position to the engaged position. The control unit may be configured to direct the feed dog drive system to lower the peak vertical position of the feed dog so that the feed dog is retracted below an outer surface of the frame base as the feed dog vertically and horizontally reciprocates relative to the sewing machine frame.

According to another aspect of the present disclosure, a sewing machine assembly may include a sewing machine frame, a feed dog assembly, and a control unit. The feed dog assembly may include a feed dog mounted to the sewing machine frame to reciprocate vertically and horizontally relative to the sewing machine frame, a feed dog drive system coupled to the feed dog and configured to drive reciprocation of the feed dog relative to the frame base, and a feed dog cover. The feed dog cover may be configured to selectively change between a disengaged position in which the feed dog cover is spaced apart from the sewing machine frame to expose the feed dog to fabric being sewn and an engaged position in which the feed dog cover extends over the feed dog to shield the fabric from the feed dog. The control unit may be coupled to the feed dog drive system.

In some embodiments, the control unit may be configured to direct the feed dog drive system to decrease a speed of the reciprocation of the feed dog when the feed dog cover is changed from the disengaged position to the engaged position. The control unit may be configured to lower a peak vertical position of the feed dog when the feed dog cover is changed from the disengaged position to the engaged position. In this way, the sewing machine assembly may change from a fixed motion mode to a free motion mode to allow a user to freely maneuver one of the sewing machine assembly and the fabric relative to the other.

In some embodiments, the control unit may include a sensor and a controller coupled to the sensor. The sensor may be coupled to the sewing machine frame configured to detect when the feed dog cover is in the engaged position. The controller may be configured to receive a signal from the sensor indicative of the feed dog cover being in the engaged position and direct the feed dog drive system to decrease the speed of the reciprocation of the feed dog in response to the signal.

In some embodiments, the sensor may be a manual button. The manual button may be configured to change between a first position associated with the fixed motion mode of the sewing machine assembly and a second position associated with the free motion mode of the sewing machine assembly.

In some embodiments, the feed dog cover may include a cover plate and a sensor tab. The cover plate may have a first side, a second side opposite the first side, and an outer edge that extends between and interconnects the first and second sides. The sensor tab may extend from the first side of the cover so as to engage the sensor when the feed dog cover is in the engaged position.

In some embodiments, the feed dog cover may further include a pair of locator tabs. The pair of locator tabs may extend from the first side of the cover plate. The pair of locator tabs may be configured to be received in locator notches on the sewing machine frame when the feed dog cover is in the engaged position so as to align the sensor tab with the manual button.

In some embodiments, the feed dog cover may further include at least one magnet coupled to the cover plate. The at least one magnet may be configured to apply a magnetic force to the sewing machine frame to draw the cover plate to the sewing machine frame so that the feed dog cover remains coupled to the sewing machine frame when the feed dog cover is in the engaged position.

In some embodiments, the cover plate of the feed dog cover may be formed to include a cavity. The cavity may extend into the first side of the cover plate. The cavity may receive the feed dog.

In some embodiments, the feed dog cover may include a cover plate, at least one locator tab, and at least one magnet. The cover plate may have a first side, a second side opposite the first side, and an outer edge that extends between and interconnects the first and second sides. The at least one locator tab may extend from the first side of the cover plate and may be configured to be received in locator notches on the sewing machine frame when the feed dog cover is in the engaged position. The at least one magnet may be coupled to the cover plate and may be configured to apply a magnetic force to the sewing machine frame to draw the cover plate to the sewing machine frame so that the feed dog cover remains coupled to the sewing machine frame when the feed dog cover is in the engaged position.

According to another aspect of the present disclosure, a method may include providing a sewing machine assembly. The sewing machine assembly may include a sewing machine frame, a presser bar mounted to the sewing machine frame, and a feed dog assembly.

In some embodiments, the feed dog assembly may include a feed dog mounted to the sewing machine frame to reciprocate horizontally relative to the sewing machine frame, a feed dog drive system configured to drive reciprocation of the feed dog relative to the frame base, and a feed dog cover. The feed dog cover may be configured to selectively change between a disengaged position in which the feed dog cover is spaced apart from the sewing machine frame to expose the feed dog to fabric being sewn and an engaged position in which the feed dog cover extends over the feed dog to shield the fabric from the feed dog.

In some embodiments, the method may further include providing a pressure foot. The method may further include attaching the presser foot to the presser bar.

In some embodiments, the method may further include locating the feed dog cover in the disengaged position to cause the sewing machine assembly to be in the fixed motion mode so that the feed dog pulls the fabric between the presser foot and the feed dog through the sewing machine while a user sews the fabric. The method may further include removing the presser foot from the presser bar, coupling a hopping foot to the presser bar, and locating the feed dog cover in the engaged position to cause the sewing machine assembly to be in the free motion mode so that the fabric between the presser foot and the feed dog is shielded from the feed dog while the user sews the fabric These and other features of the present disclosure will become more apparent from the following description of the illustrative embodiments.

DETAILED DESCRIPTION OF THE DRAWINGS

Figure 2A:
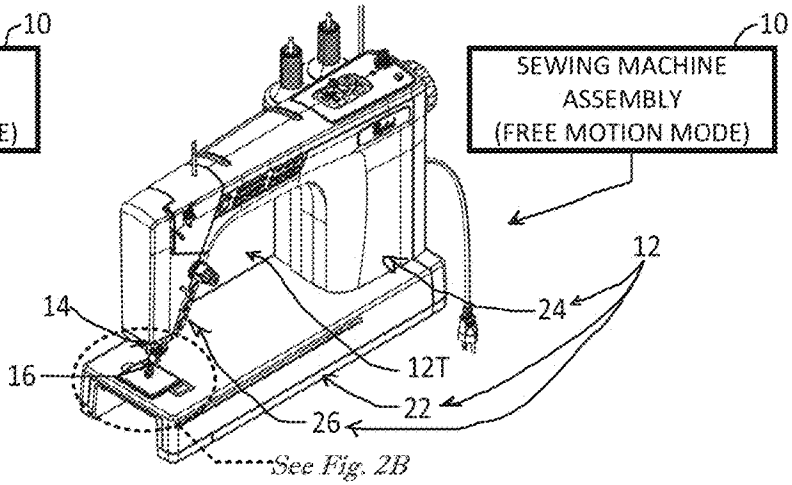
FIG. 2A is a perspective view of the sewing machine assembly of FIG. 1 with the sewing machine assembly has changed to the free motion mode.

For the purposes of promoting an understanding of the principles of the disclosure, reference will now be made to a number of illustrative embodiments illustrated in the drawings and specific language will be used to describe the same.

Figure 2B:
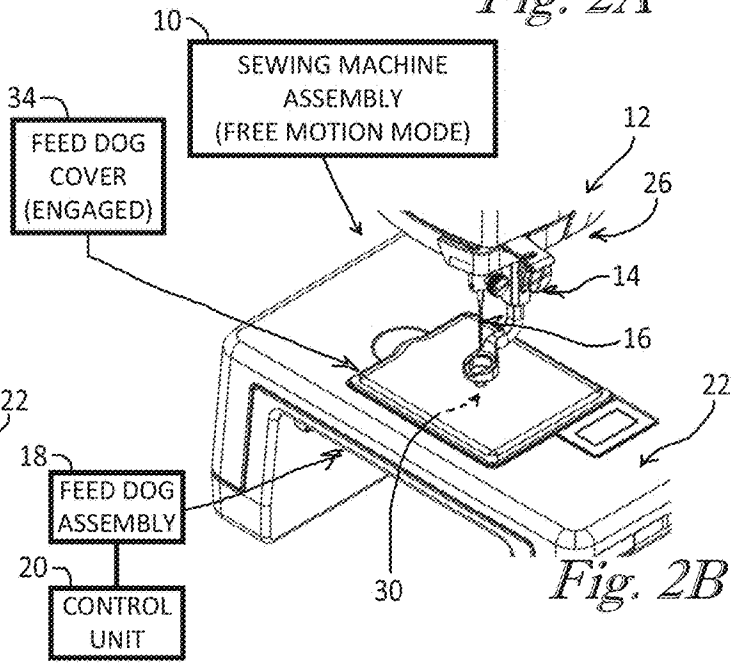
FIG. 2B is a detail view of FIG. 2A showing the feed dog cover has been moved from a disengaged position as shown in FIG. 1B to an engaged position in which the feed dog cover extends over the feed dog to shield the fabric from the feed dog while the sewing machine assembly is in the free motion mode.
Figure 1A:
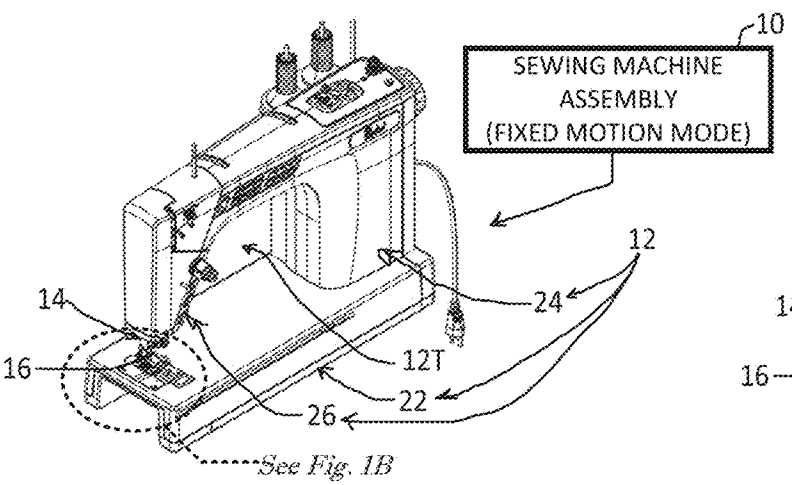
FIG. 1A is a perspective view of a sewing machine assembly in a fixed motion mode.
Figure 1B:
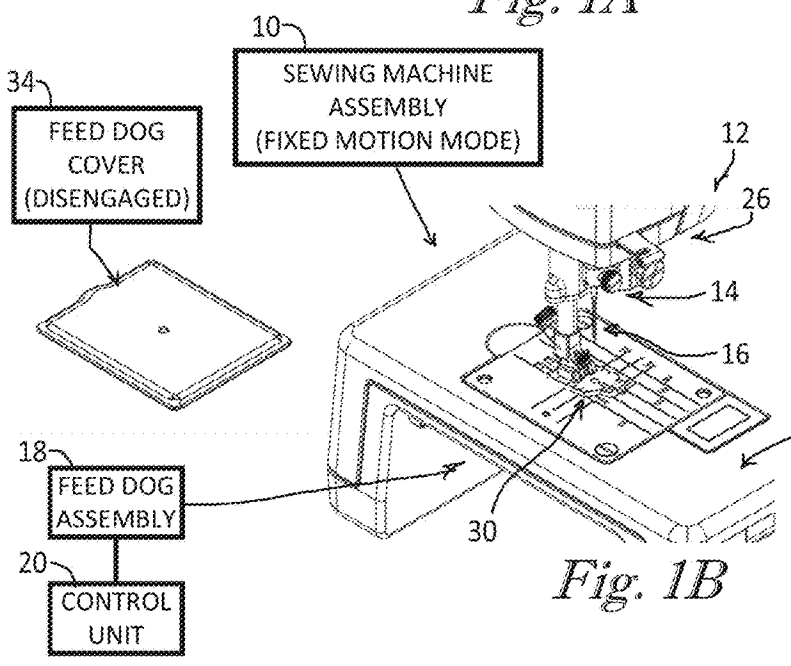
FIG. 1B is a detail view of FIG. 1A showing the sewing machine assembly includes a sewing machine frame with a frame base, a frame body that extends from the base, and a frame head that extends from the frame body toward the frame base, a presser bar mounted to the frame head that has a presser foot coupled thereto, and a free dog assembly, further showing the feed dog assembly includes a feed dog mounted to the frame base to reciprocate horizontally relative to the frame base to pull fabric between the pressure bar and the frame base through the sewing machine and a feed dog cover to be selectively coupled to the frame base to change the sewing machine assembly from the fixed motion mode to a free motion mode.

An illustrative embodiment of a sewing machine assembly 10 is shown in FIG. 1A. The sewing machine assembly 10 is configured change between a fixed motion mode as shown in FIGS. 1A and 1B and a free motion mode as shown in FIGS. 2A and 2B.

In the free motion mode, a user is able to freely maneuver one of the sewing machine assembly and the fabric relative to the other. This allows the user to create intricate patterns with the stitching.

In some embodiments, the sewing machine assembly may be on a machine carriage that allows the sewing machine assembly to be moved in lateral and longitudinal directions. The fabric may remain in place, while the sewing machine is moved relative to the fabric to sew the fabric. Alternatively, the user may maneuver the fabric relative to the stationary sewing machine assembly to create the intricate patterns with the stitching.

In the fixed motion mode, the sewing machine is fixed in place and the fabric is fed through the sewing machine to sew the fabric. In the fixed motion mode, a feed dog assembly may be used to pull the fabric through the sewing machine. Unlike the free motion mode, the fabric only moves in one direction through the sewing machine assembly to sew a relatively straight stitch line.

Typically, a sewing machine is only operable in one of the free motion mode or the fixed motion mode. The user would then need to switch between different machines depending on the desired stitching.

Figure 9:
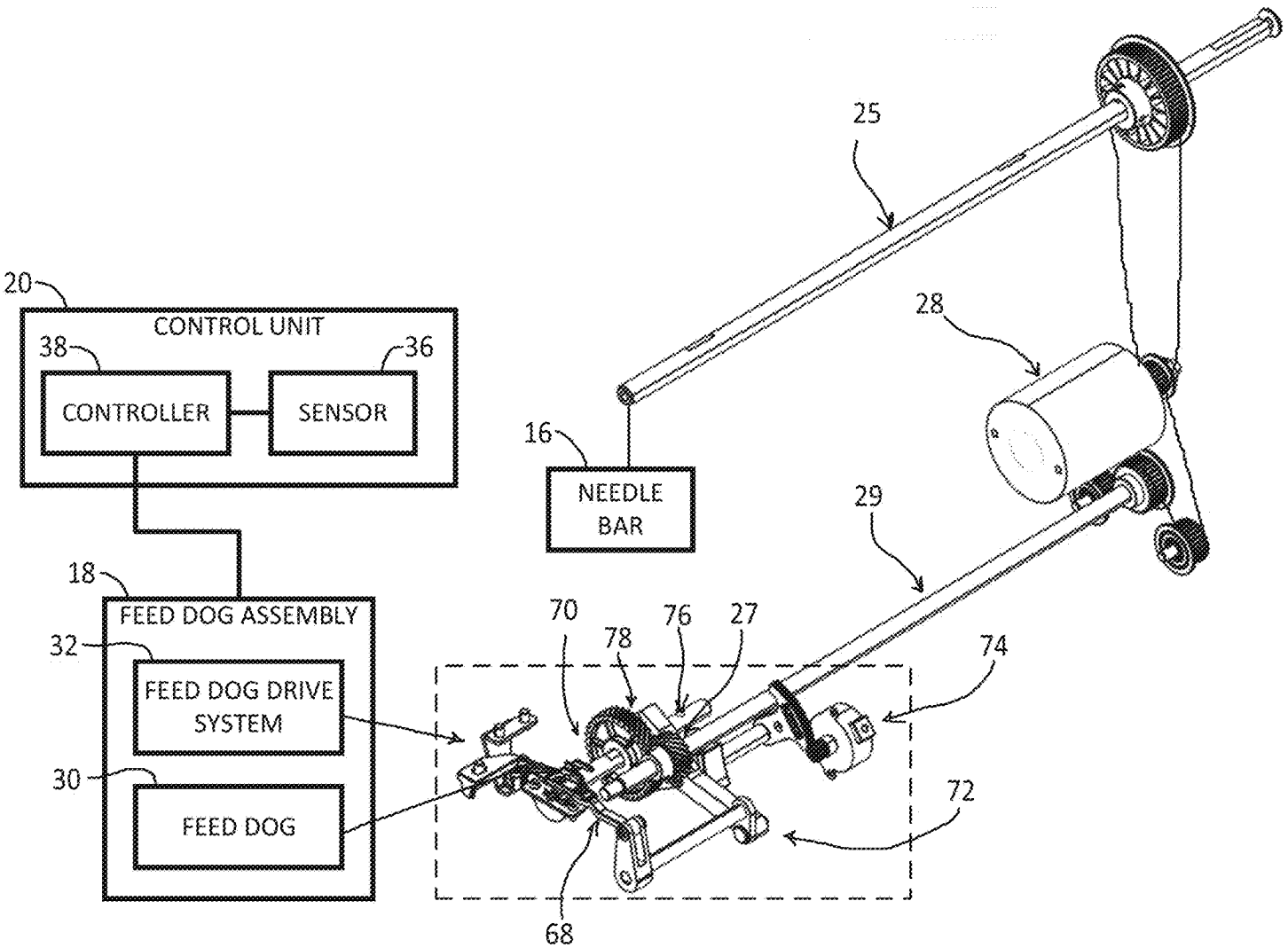
FIG. 9 is a perspective view of the sewing machine assembly of FIGS. 1A and 2A with the sewing machine frame removed to show the feed dog assembly including the feed dog and the feed dog drive system.

Therefore, the sewing machine assembly 10 is convertible between the free motion mode and the fixed motion mode as shown in FIG. 9. The sewing machine assembly 10 includes a feed dog assembly 18 that includes a feed dog 30 mounted to the sewing machine frame 12 to reciprocate vertically and horizontally relative to the sewing machine frame 12 in a substantially elliptical shape as suggested in FIG. 11 and a feed dog drive system 32 coupled to the feed dog 30 to drive reciprocation of the feed dog 30. The feed dog 30 reciprocates vertically and horizontally relative to the sewing machine frame 12 to pull the fabric therethrough when the sewing machine assembly 10 is in the fixed motion mode.

Figure 3:
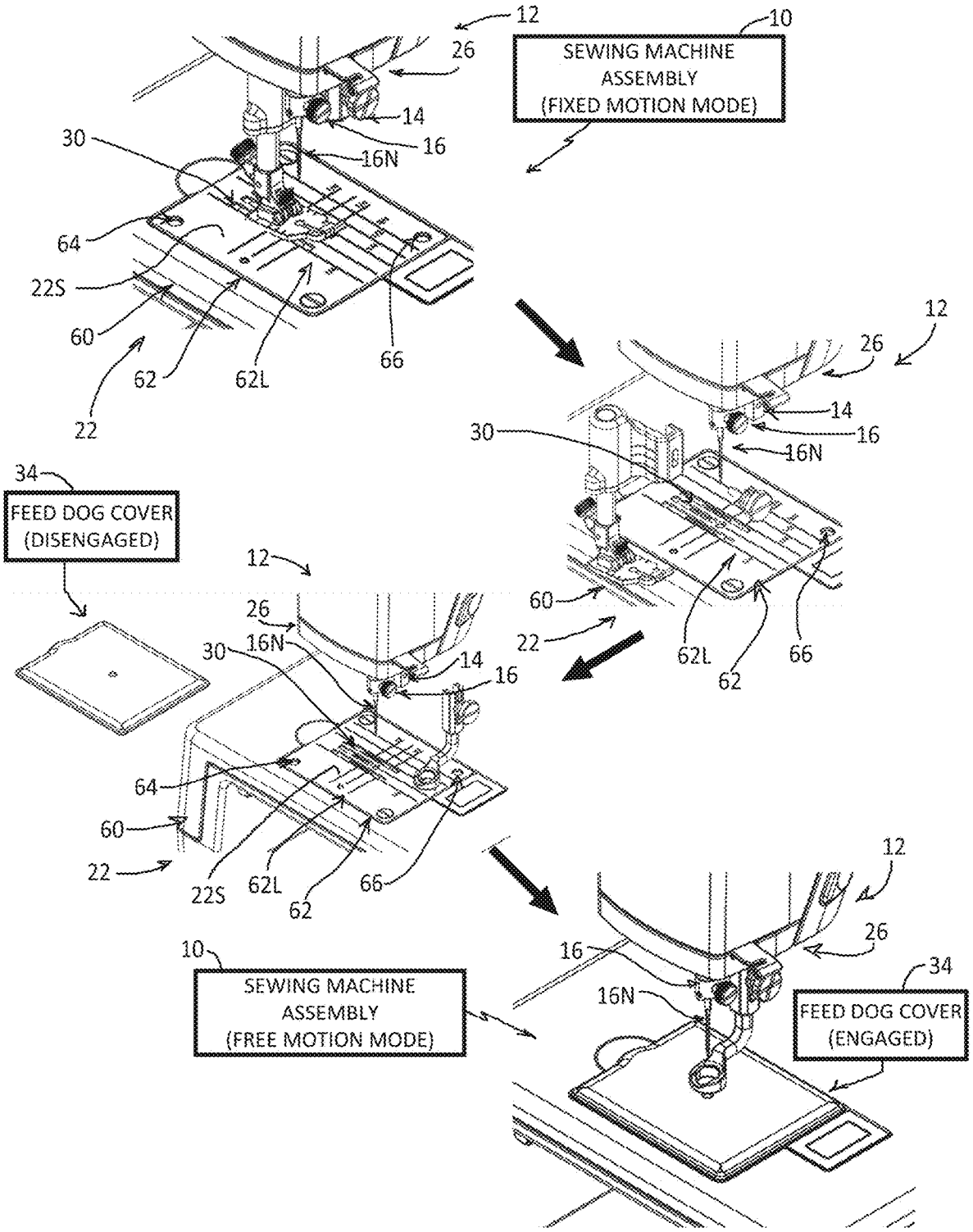
FIG. 3 is a diagrammatic view of a process of changing the sewing machine assembly of FIG. 1A from the fixed motion mode to the free motion mode by removing the presser foot from the presser bar, locating the free dog cover in the engaged position to cause the sewing machine assembly to be in the free motion mode, and coupling the hopping foot to the presser bar.

The feed dog 30, however, may not be needed when the sewing machine assembly 10 is in the free motion mode. Therefore, the feed dog assembly 18 further includes a feed dog cover 34 as shown in FIGS. 1-3. The feed dog cover 34 is configured to selectively change between a disengaged position as shown in FIG. 1B and an engaged position as shown in FIG. 2B.

In the disengaged position, the feed dog cover 34 is spaced apart from the frame base 22 to expose the feed dog 30 to the fabric so that the sewing machine assembly 10 is in the fixed motion mode. In the engaged position, the feed dog cover 34 extends over the feed dog 30 to shield the fabric from the feed dog 30 so that the sewing machine assembly 10 is in the free motion mode.

The sewing machine assembly 10 further includes a control unit 20 coupled to the feed dog drive system 32 and configured to control the speed and/or position of the feed dog 30 when the feed dog cover 34 is changed from the disengaged position to the engaged position. In this way, the sewing machine assembly 10 changes from the fixed motion mode to the free motion mode thereby allowing the user to freely maneuver one of the sewing machine assembly 10 and the fabric relative to the other.

The control unit 20 is configured to direct the feed dog drive system 32 to decrease a speed of the reciprocation of the feed dog 30 when the feed dog cover 34 is changed from the disengaged position to the engaged position. By slowing the reciprocation of the feed dog 30 in the free motion mode, the user may be able to more easily maneuver the sewing machine assembly 10 in the lateral and longitudinal directions because the motion of the feed dog 30 and any residual vibration is reduced.

The control unit 20 is also configured to adjust a peak vertical position of the feed dog 30 as the feed dog 30 reciprocates vertically and horizontally relative to the sewing machine frame 12. As the feed dog 30 moves in a first horizontal direction, the feed dog 30 is at the peak vertical position to protrude above a surface 22S of the frame base 22. As the feed dog 30 begins to move in the second horizontal direction opposite the first horizontal direction, the feed dog 30 is lowered to a minimum vertical position so that the feed dog 30 is retracted below the surface 22S.

The control unit 20 is configured to direct the feed dog drive system to decrease the peak vertical position of the feed dog 30 when the feed dog cover is changed from the disengaged position to the engaged position so that even at the peak vertical position, the feed dog 30 does not extend as far above the surface 22S. In some embodiments, the feed dog 30 may not protrude above the surface 22S, when the feed dog cover 34 is in the engaged position.

Figure 10:
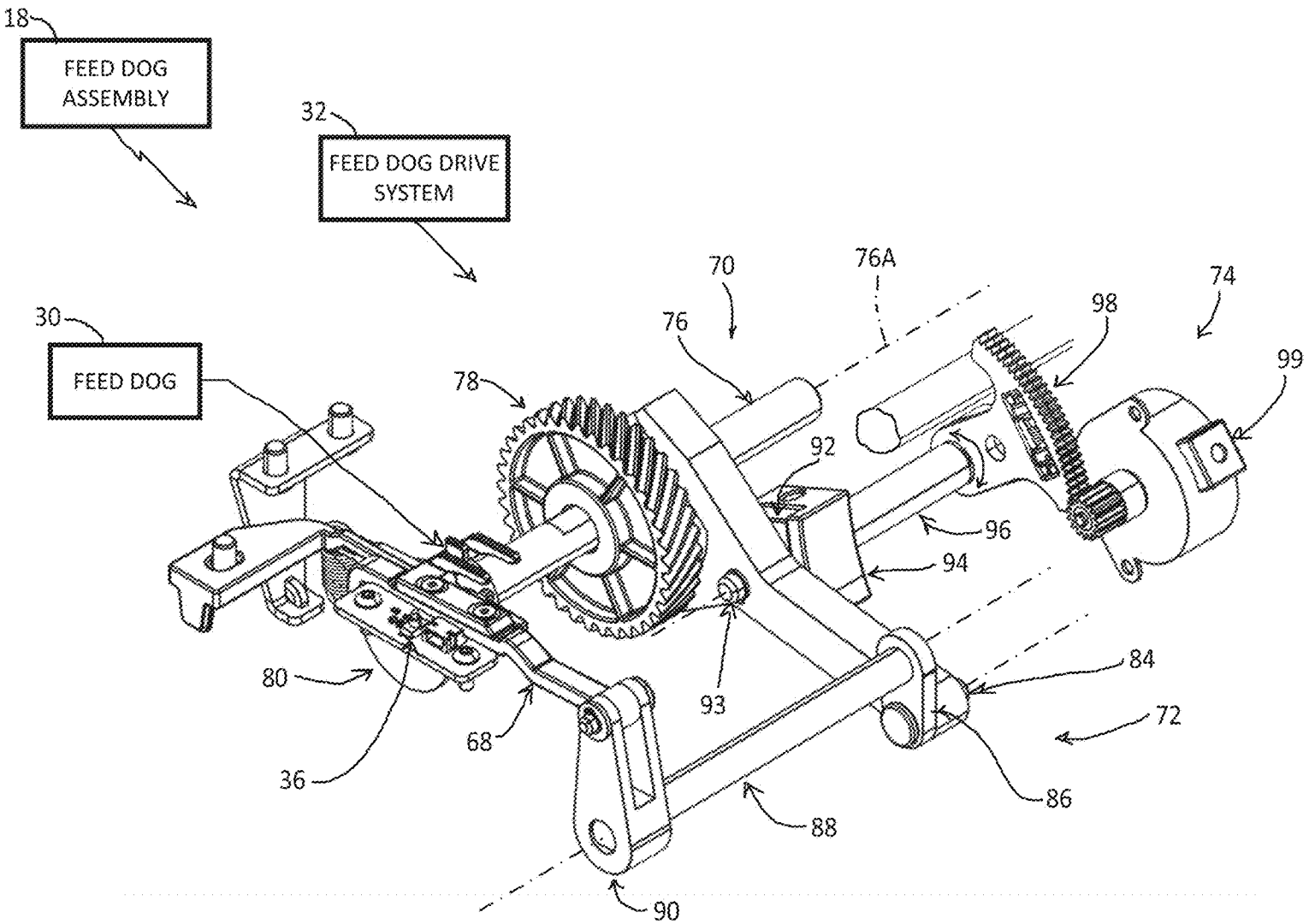
FIG. 10 is a detail view of FIG. 9 showing the feed dog drive system includes a feed bar coupled to the feed dog, a horizontal drive assembly coupled to the feed bar to drive horizontal movement of the feed dog, a vertical drive assembly engaged with the feed bar to drive vertical movement of the feed dog as the feed bar reciprocates horizontally, and a speed adjuster coupled to the horizontal drive assembly to adjust the speed of the reciprocation of the feed dog.
Figure 11:
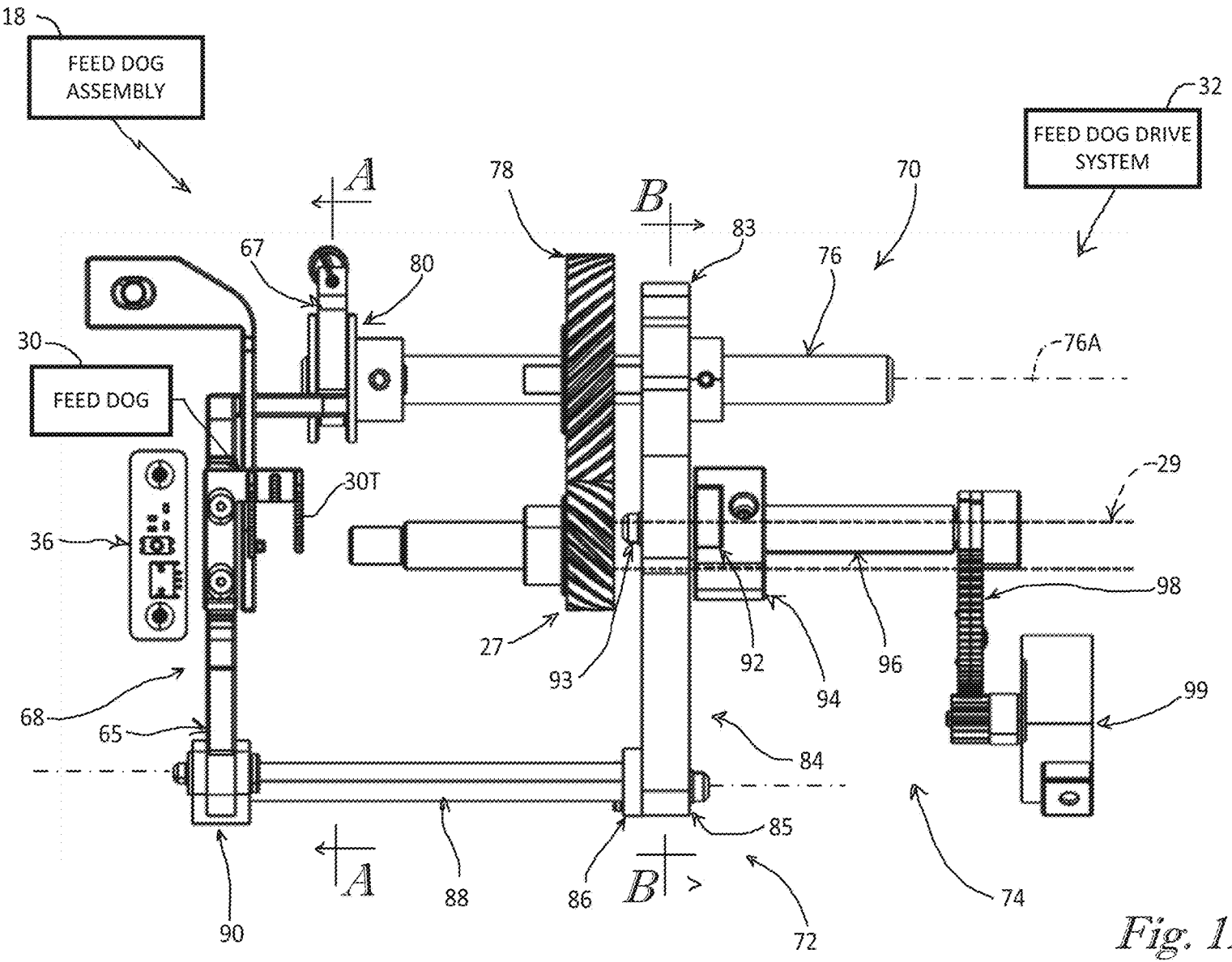
FIG. 11 is a top view of the feed dog drive system of FIG. 10 showing the vertical drive system includes a vertical drive shaft that rotates about a first axis, a drive gear coupled to the vertical drive shaft for rotation therewith, a vertically moving cam coupled to the drive shaft for rotation therewith that engages the feed bar to move the feed bar vertically when the vertically moving cam rotates about the first axis, showing the horizontal drive assembly includes a cam coupled to the vertical drive shaft for rotation therewith, cam link that engages the cam so that the cam drives movement of the cam link, a horizontal rock shaft, a horizontal swing arm coupled to the opposite end of the cam link and extends between and interconnects the horizontal rock shaft and the cam link, and a rock shaft crank coupled to the horizontal rock shaft opposite the horizontal swing arm and coupled to feed bar to drive horizontal movement of the feed dog, and showing the speed adjuster assembly includes a slide member coupled to the cam link, a speed adjust member defining a groove that receives the slide member, an adjuster shaft having one end coupled to the speed adjust member for rotation therewith, a gear member coupled to the other end of the adjuster shaft, and a motor that mates with the gear member to transfer rotation to the adjuster shaft.

The control unit 20 includes a sensor 36 and a controller 38 coupled to the sensor 36 as shown in FIGS. 9-11 The sensor 36 is coupled to a frame base 22 of the sewing machine frame 12 and configured to detect when the feed dog cover 34 is in the engaged position. The controller 38 is configured to receive a signal from the sensor 36 indicative of the feed dog cover 34 being in the engaged position. The controller 38 is then configured to direct the feed dog drive system 32 to decrease the speed of the reciprocation of the feed dog 30 in response to the signal.

Figure 7:
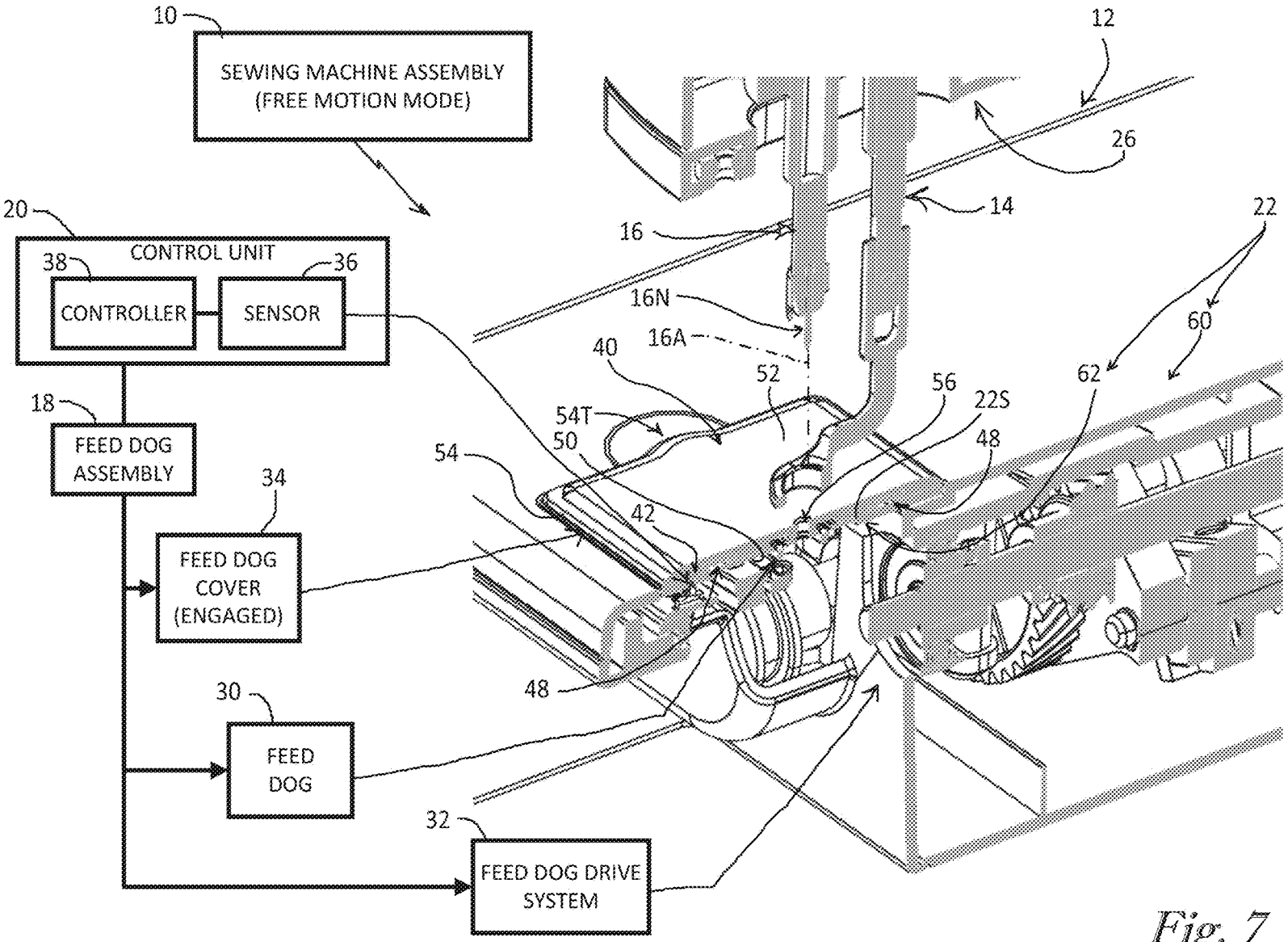
FIG. 7 is a cross-section view of the sewing machine assembly of FIG. 6 taken along line 7-7 showing the control system includes a sensor coupled to the frame base of the sewing machine frame and configured to detect when the feed dog cover is in the engaged position and a controller coupled to the sensor to receive a signal from the sensor indicative of the feed dog cover being in the engaged position and configured to direct the feed dog drive system to decrease the speed of the reciprocation of the feed dog in response to the signal.

The sensor 36 may be a manual button 36 as shown in FIGS. 7, 10, and 11. The sensor 36 is configured to change between a first position associated with the fixed motion mode of the sewing machine assembly 10 and a second position associated with the free motion mode of the sewing machine assembly 10. The feed dog cover 34 is configured to engage the sensor 36 when the feed dog cover 34 is moved to the engaged position so as to change the sensor 36 from the first position to the second position.

The feed dog cover 34 includes a cover plate 40, sensor tab 42, a pair of locator tabs 44, 46, and at least one magnet 48 as shown in FIGS. 4-8. The cover plate 40 has a first side 50 that faces the sewing machine frame 12, a second side 52 opposite the first side that faces away from the sewing machine frame 12, and an outer edge 54 that extends between and interconnects the first and second sides 50, 52. A needle opening 56 extends through the first side 50 and the second side 52 of the cover plate 40. The sensor tab 42 extends from the first side 50 of the cover plate 40 so as to engage the sensor 36 when the feed dog cover 34 is in the engaged position to change the sensor 36 from the first position to the second position. The pair of locator tabs 44, 46 extend away from the first side of the cover plate 40. The magnet 48 is coupled to the cover plate 40. The outer edge 54 may have an edge tab 54T that makes it easier to lift the feed dog cover 34 from the frame base 22.

The pair of locator tabs 44, 46 are configured to be received in locator notches on the sewing machine frame 12 when the feed dog cover 34 is in the engaged position. The pair of locator tabs 44, 46 are received in locator notches 64, 66 on the frame base 22 of the sewing machine frame 12 when the feed dog cover 34 is in the engaged position so as to align the sensor tab 42 with the sensor 36.

The magnet 48 is configured to apply a magnetic force to the frame base 22 of the sewing machine frame 12. The magnet 48 applies the magnetic force to the frame base 22 to draw the cover plate 40 to the frame base 22 so that the feed dog cover 34 remains coupled to the frame base 22 when the feed dog cover is in the engaged position.

In the illustrative embodiment, the feed dog cover 34 includes more than one magnet 48. The magnets 48 are spaced apart from one another. Each magnet 48 applies the magnetic force to the frame base 22.

Figure 4:
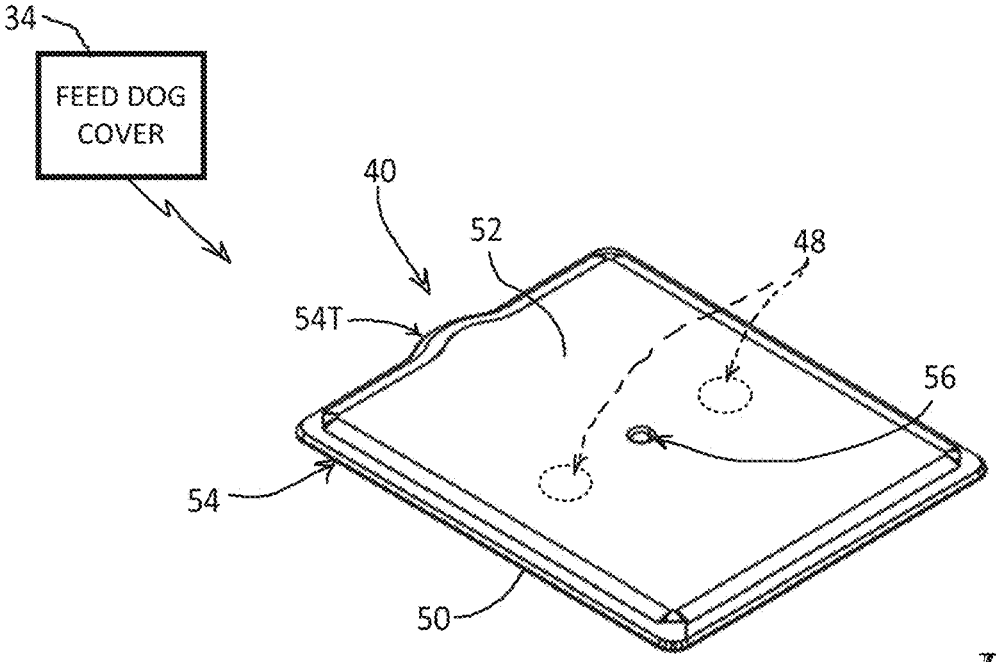
FIG. 4 is a perspective view of a top side of the feed dog cover included in the feed dog assembly of the sewing machine assembly of FIG. 1A showing the feed dog cover includes a cover plate having the top side, a bottom side opposite the top side, and an outer edge that extends between and interconnects the top and bottom sides with a need hole that extends through the top and bottom sides.
Figure 5:
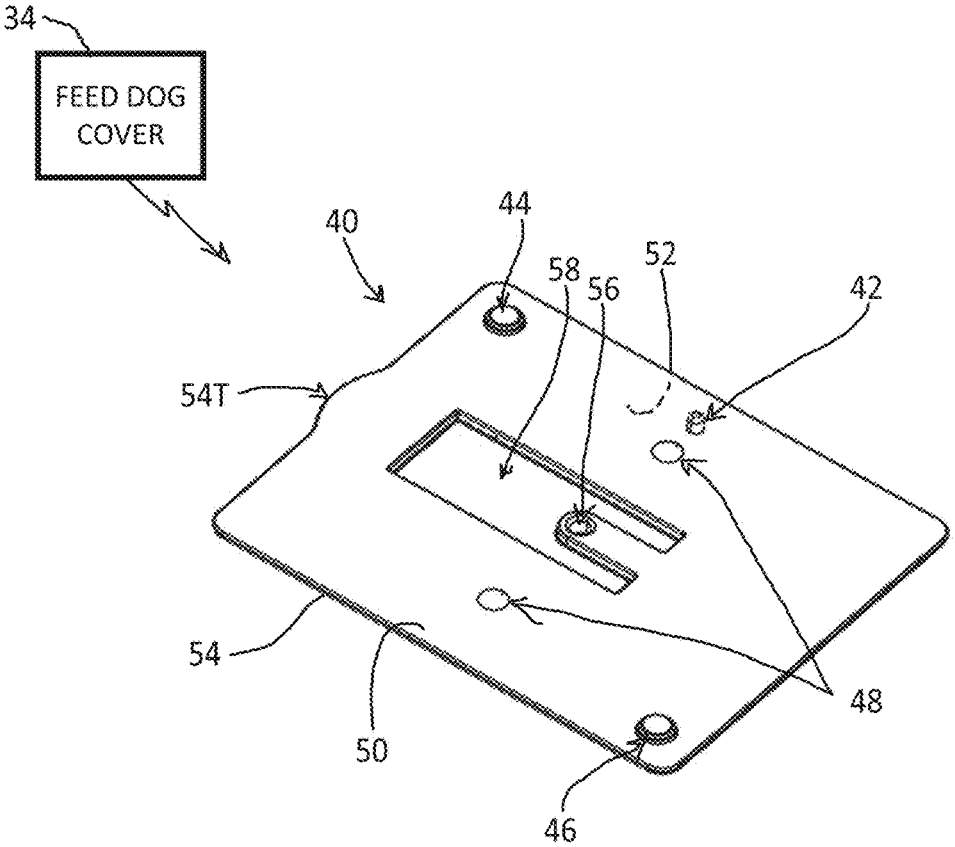
FIG. 5 is a perspective view of a bottom side of the feed dog cover of FIG. 4 showing the feed dog cover further includes a pair of locator tabs that extend from the bottom side of the cover plate, magnets coupled to the cover plate that apply a magnetic force to the frame base to draw the cover plate to the frame base so that the feed dog cover remains coupled to the frame base when the feed dog cover is in the engaged position, and a sensor tab.
Figure 6:
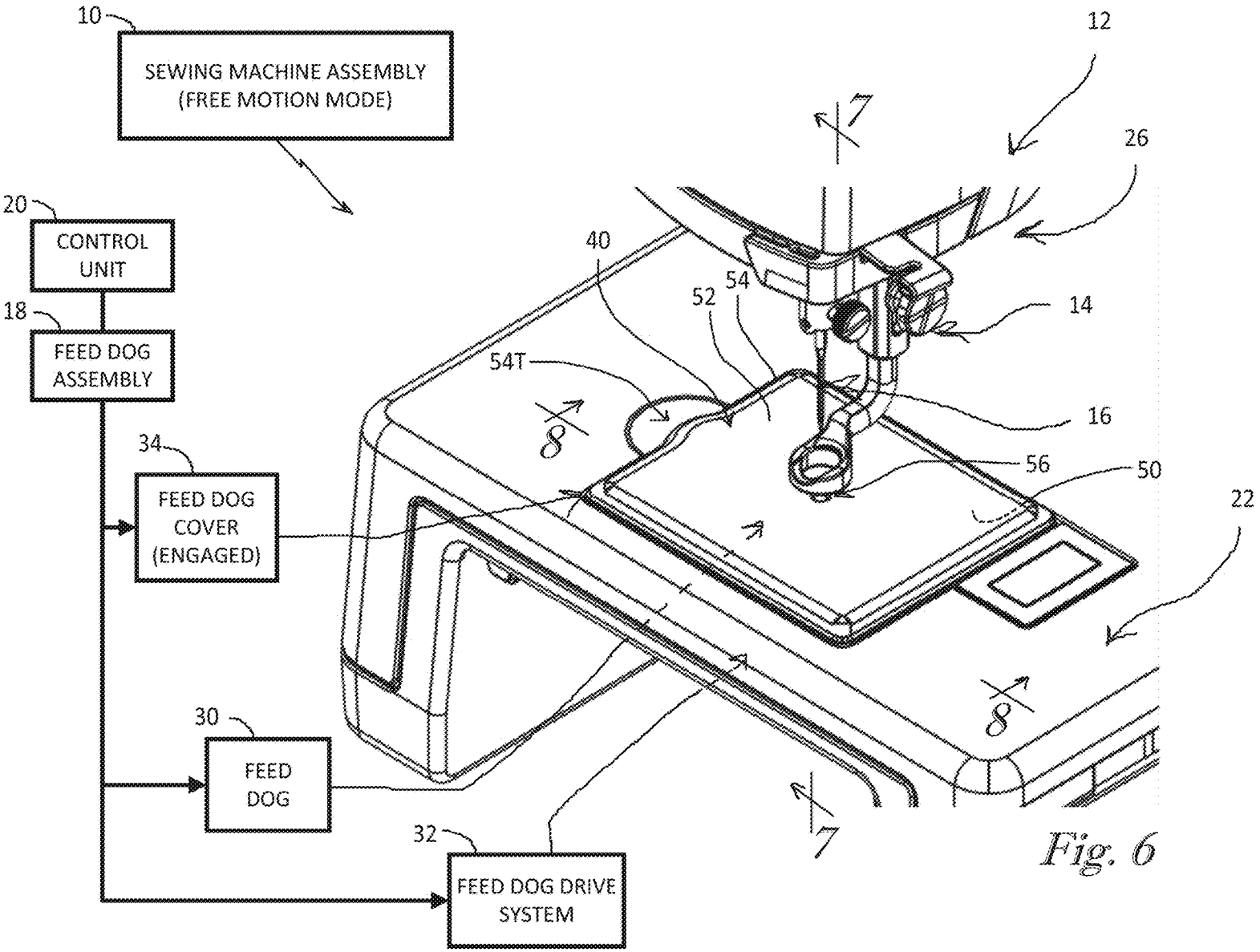
FIG. 6 is a perspective view of the sewing machine assembly of FIG. 2B showing the feed dog cover is in the engaged position to cause the sewing machine assembly to be in the free motion mode, and further showing the sewing machine assembly further includes a control system coupled to the feed dog assembly and configured to control the speed and/or position of the feed dog when the feed dog cover is changed from the disengaged position to the engaged position.

The cover plate 40 is formed to define a cavity 58 as shown in FIG. 4. The cavity 58 extends into the first side 52 of the cover plate 40. The cavity 58 is sized to receive the feed dog 30.

Turning again to the sewing machine assembly 10, the sewing machine assembly 10 has a sewing machine frame 12, a presser bar 14, a needle bar 16, the feed dog assembly 18, and a control unit 20 as shown in FIGS. 1-3. The sewing machine frame 12 includes the frame base 22, a frame body 24 that extends from the frame base 22, and a frame head 26 coupled to the frame body 24 that extends from the frame body 24 toward the frame base 22 to define a throat 12T of the sewing machine frame 12.

The presser bar 14 is attached to a frame head 26 of the sewing machine frame 12 and extends toward a frame base 22. A presser foot or a hopping foot are selectively coupled to the presser bar 14. The needle bar 16 is attached to the frame head 26 of the sewing machine frame 12 and configured to linearly reciprocate relative to the frame head 26 along a needle bar axis 16A. A needle 16N is coupled to the needle bar 16.

Figure 8:
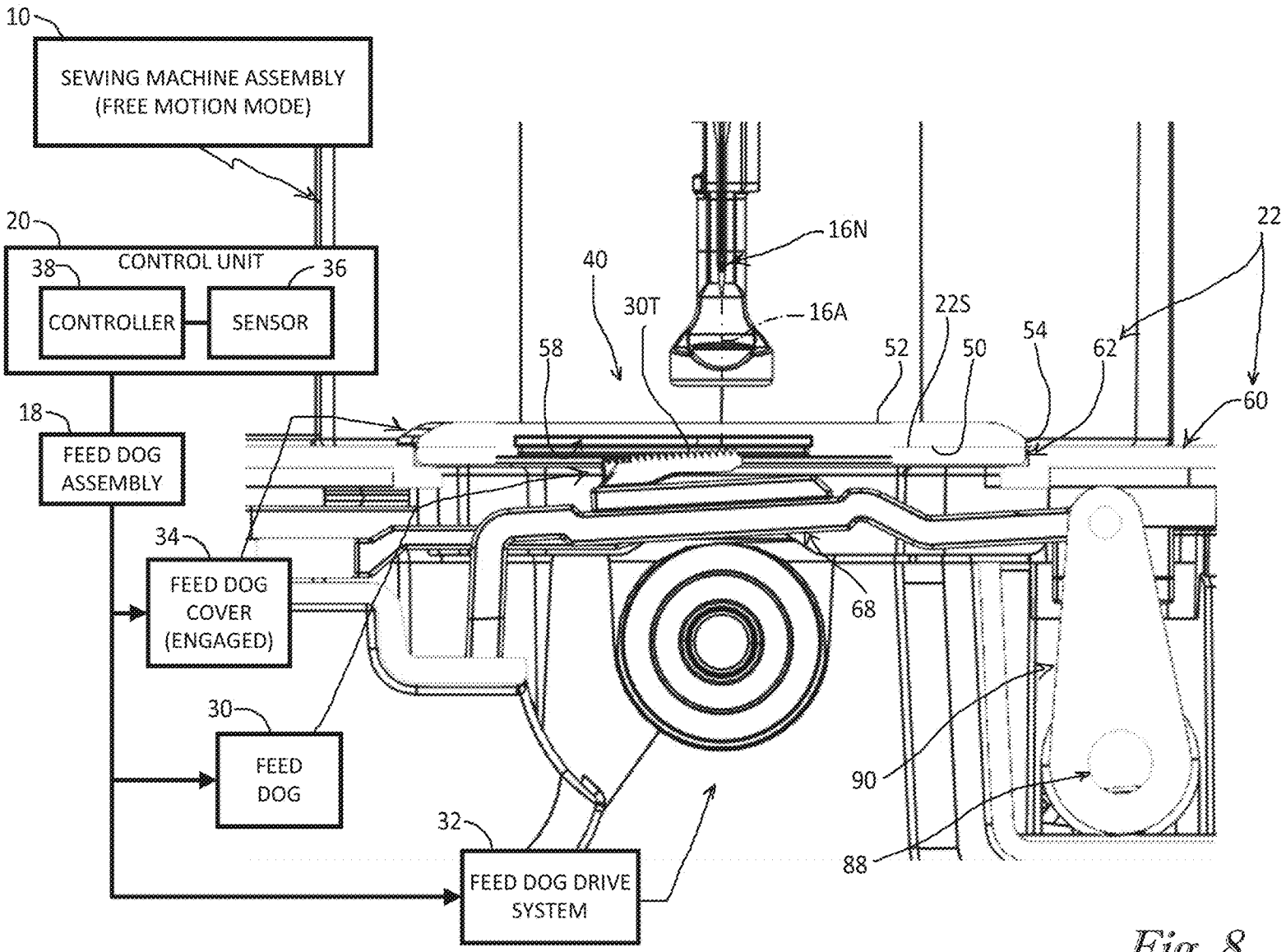
FIG. 8 is a cross-section view of the sewing machine assembly of FIG. 6 taken along line 8-8 showing the feed dog cover in the engaged position to cover the feed dog.

The frame base 22 of the sewing machine frame 12 has a frame base housing 60 and a guide plate 62 as shown in FIGS. 3, 7, and 8. The guide plate 62 is coupled to the frame base housing 60 so that the guide plate 62 is under the frame head 26. The guide plate 62 is formed to define a plurality of guide lines 62L configured to help the user orientate the fabric to be sewn.

In the illustrative embodiment, the guide plate 62 is formed to include the corresponding locating notches 64, 66 as shown in FIG. 3. The locating notches 64, 66 in the guide plate 62 mate with the locator tabs 44, 46 on the cover plate 40 to properly position the cover plate 40 over the feed dog 30.

The feed dog assembly 18 includes the feed dog 30, the feed dog drive system 32, and the feed dog cover 34 as shown in FIGS. 1B, 2B, and 6-14. The feed dog 30 is mounted to the frame base 22 to reciprocate horizontally relative to the frame base 22 to pull fabric between the presser bar 14 and the frame base 22 through the sewing machine frame 12. The feed dog drive system 32 is configured to drive reciprocation of the feed dog 30 relative to the frame base 22. The feed dog cover 34 is configured to selectively change between the disengaged position as shown in FIG. 1B and the engaged position as shown in FIG. 2B.

In the disengaged position, the feed dog cover 34 is spaced apart from the frame base 22 to expose the feed dog 30 to the fabric so that the sewing machine assembly 10 is in the fixed motion mode. In the engaged position, the feed dog cover 34 extends over the feed dog 30 to shield the fabric from the feed dog 30 so that the sewing machine assembly 10 is in the free motion mode.

The control unit 20 is coupled to the feed dog drive system 32 as shown in FIG. 1-3. The control unit 20 is configured to control the speed and/or position of the feed dog 30 when the feed dog cover 34 is changed from the disengaged position to the engaged position. In this way, the sewing machine assembly 10 changes from the fixed motion mode to the free motion mode thereby allowing the user to freely maneuver one of the sewing machine assembly 10 and the fabric relative to the other.

The control unit 20 is configured to direct the feed dog drive system 32 to decrease a speed of the reciprocation of the feed dog 30 when the feed dog cover 34 is changed from the disengaged position to the engaged position. By slowing the reciprocation of the feed dog 30 in the free motion mode, the user may be able to more easily maneuver the sewing machine assembly 10 in the lateral and longitudinal directions because the motion of the feed dog 30 and any residual vibration is reduced.

The control unit 20 is configured to direct the feed dog drive system to decrease the peak vertical position of the feed dog 30 when the feed dog cover is changed from the disengaged position to the engaged position so that even at the peak vertical position, the feed dog 30 does not extend as far above the surface 22S. In some embodiments, the feed dog 30 may not protrude above the surface 22S, when the feed dog cover 34 is in the engaged position.

Figure 12:
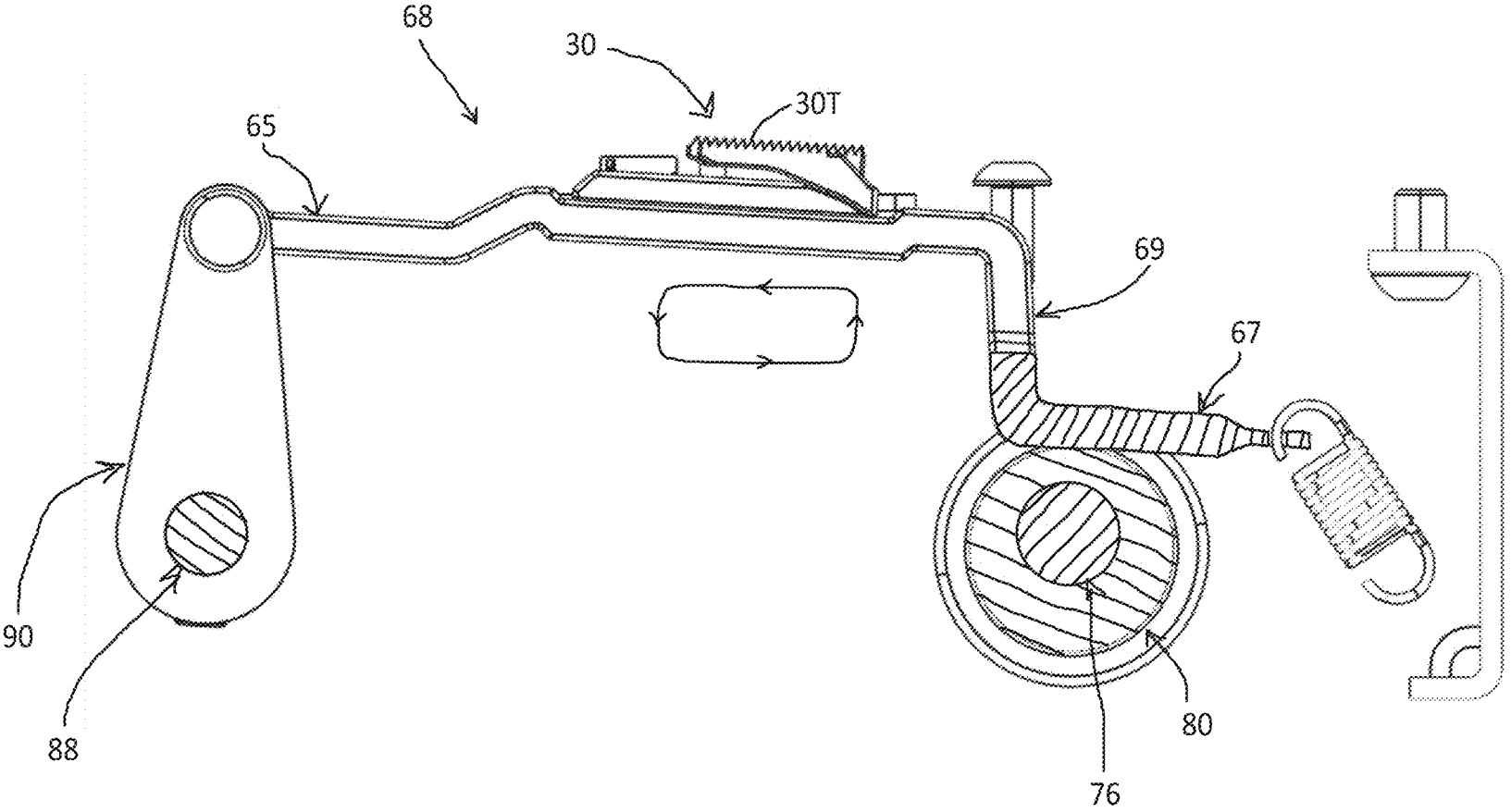
FIG. 12 is a cross-section view of the feed dog drive system of FIG. 11 taking along A-A showing the feed bar has a first horizontally-extending section coupled to the rock shaft crank, a second horizontally-extending section spaced apart vertically from the first horizontally-extending section that engages the vertically moving cam, and an interconnecting section that extends between and interconnects the first horizontally-extending section and the second horizontally-extending section.

The feed dog 30 includes a plurality of teeth 30T as shown in FIGS. 8, 11, and 12. The teeth 30T grip the fabric to pull the fabric through the sewing machine frame 12.

The feed dog drive system 32 includes a feed bar 68, a vertical drive assembly 70, a horizontal drive assembly 72, and a speed adjuster 74 as shown in FIGS. 9-14. The feed bar 68 is coupled to the feed dog 30. The horizontal drive assembly 72 is coupled to the feed bar 68 and configured to drive horizontal movement of the feed dog 30. The vertical drive assembly 70 is engaged with the feed bar 68 and configured to drive vertical movement of the feed dog 30 as the feed dog 30 reciprocates horizontally so that the feed dog 30 moves in a substantially elliptical manner. The speed adjuster 74 is coupled to the horizontal drive assembly 72 to adjust the speed of the reciprocation of the feed dog 30.

The feed bar 68 includes a first horizontally-extending section 65 that defines a first end of the feed bar 68, a second horizontally-extending section 67 that defines a second end of the feed bar 68, and an interconnecting section 69 as shown in FIGS. 11 and 12. The second horizontally-extending section 67 is spaced apart vertically from the first horizontally-extending section 65. The interconnecting section 69 extends between and interconnects the first horizontally-extending section 65 and the second horizontally-extending section 67. The feed dog 30 is coupled to the first horizontally-extending section 65 in the illustrative embodiment.

The vertical drive assembly 70 includes a vertical drive shaft 76 configured to rotate about a first axis 76A, a drive gear 78 coupled to the drive shaft 76 for rotation therewith, a vertically moving cam 80 coupled to the drive shaft 76 for rotation therewith as shown in FIGS. 9-14. The drive gear 78 engages a gear 27 on a main shaft 29 coupled to a sewing machine motor 28. The sewing machine motor 28 rotates the main shaft 29 so that the gear 27 engaged with the drive gear 78 drives rotation of the vertical drive shaft 76. The vertically moving cam 80 engages the feed bar 68 to move the feed bar 68 vertically when the vertically moving cam 80 rotates about the first axis 76A.

The vertical drive shaft 76 and the main shaft 29 are both supported by the frame base 22 of the sewing machine frame 12. Each shaft 76, 29 may include bearings coupled to the frame base 22 to support each shaft for rotation relative to the frame base 22.

The second horizontally-extending section 67 of the feed bar 68 engages the vertically moving cam 80 so that the vertically moving cam 80 supports the second end of the feed bar 68 in the illustrative embodiment. The second horizontally-extending section 67 of the feed bar 68 is able to slide along the cam surface of the vertically moving cam 80.

In the illustrative embodiment, a sewing machine motor 28 also drives movement of the needle bar drive system (not shown). The motor 28 may be coupled to a drive shaft 25 that is coupled to the need bar drive system to drive reciprocating vertical movement of the needle bar 16.

The horizontal drive assembly includes a cam 82, a cam link 84, horizontal swing arm 86, a horizontal rock shaft 88, and a rock shaft crank 90 as shown in FIGS. 10-14. The cam 82 is coupled to the vertical drive shaft 76 for rotation therewith. The cam link 84 forms a notch 84N that receives the cam 82. The cam 82 rotates about the axis 76A to drive movement of the cam link 84. The horizontal swing arm 86 is coupled to the opposite end of the cam link 84 and extends between and interconnects the horizontal rock shaft 88 and the cam link 84. The rock shaft crank 90 is coupled to the horizontal rock shaft 88 opposite the horizontal swing arm 86. The rock shaft crank 90 is coupled to the first horizontally-extending section 65 of the feed bar 68 to transfer the movement to drive horizontal movement of the feed dog 30.

Similar to the vertical drive shaft 76, the horizontal rock shaft 88 is supported by the frame base 22 of the sewing machine frame 12. The horizontal rock shaft 88 may include bearings coupled to the frame base 22 to support the horizontal rock shaft 88 for rotation relative to the frame base 22.

Figure 13:
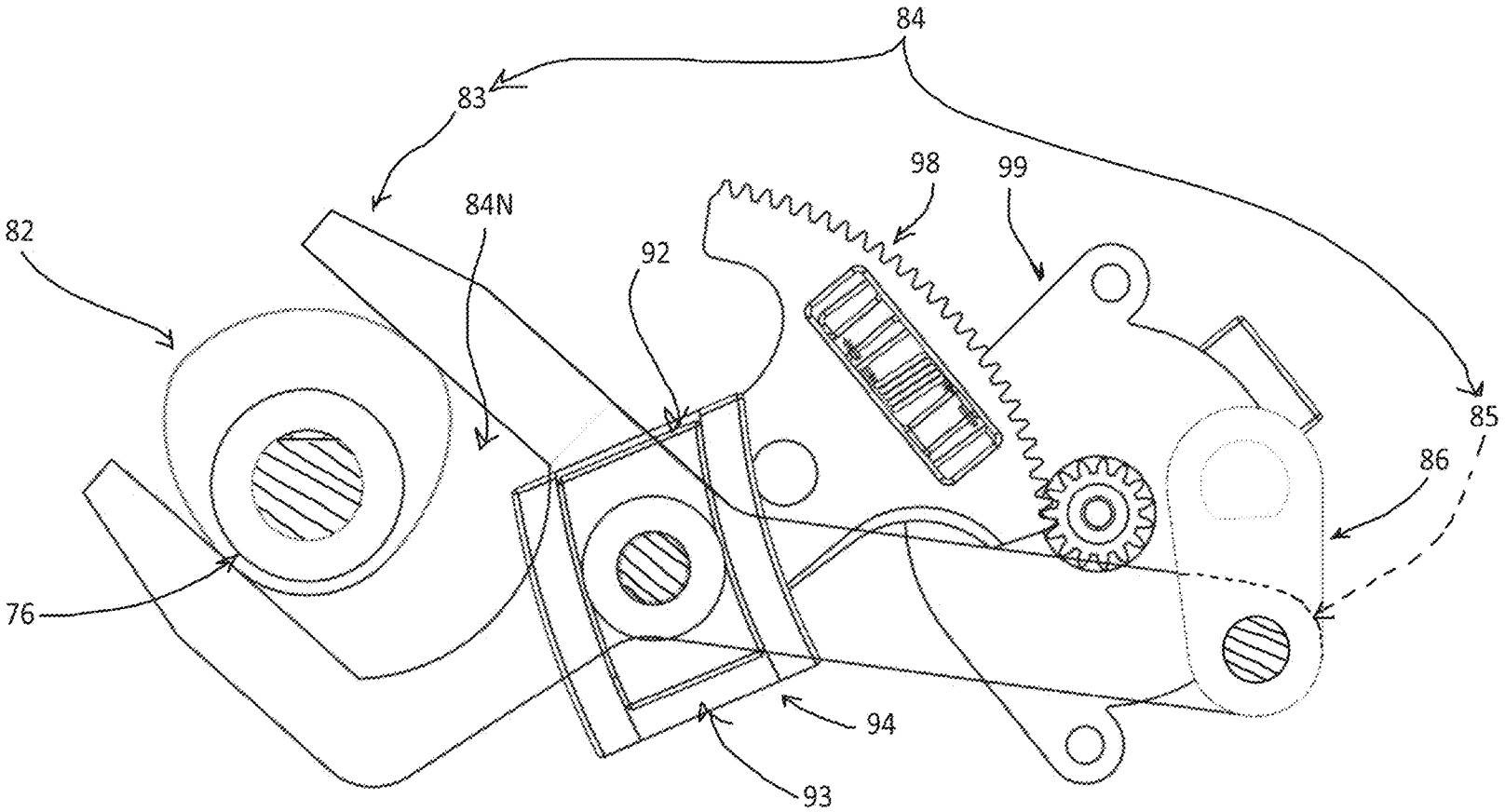
FIG. 13 is a cross-section view of the feed dog drive system of FIG. 11 taking along B-B showing the cam link of the horizontal drive assembly has a first end formed to include a cam notch that receives the cam and a second end coupled to the horizontal swing arm, and further showing the slide member is pinned to the cam link such that movement of the cam link is restricted in the sliding direction of the slide member.
Figure 14:
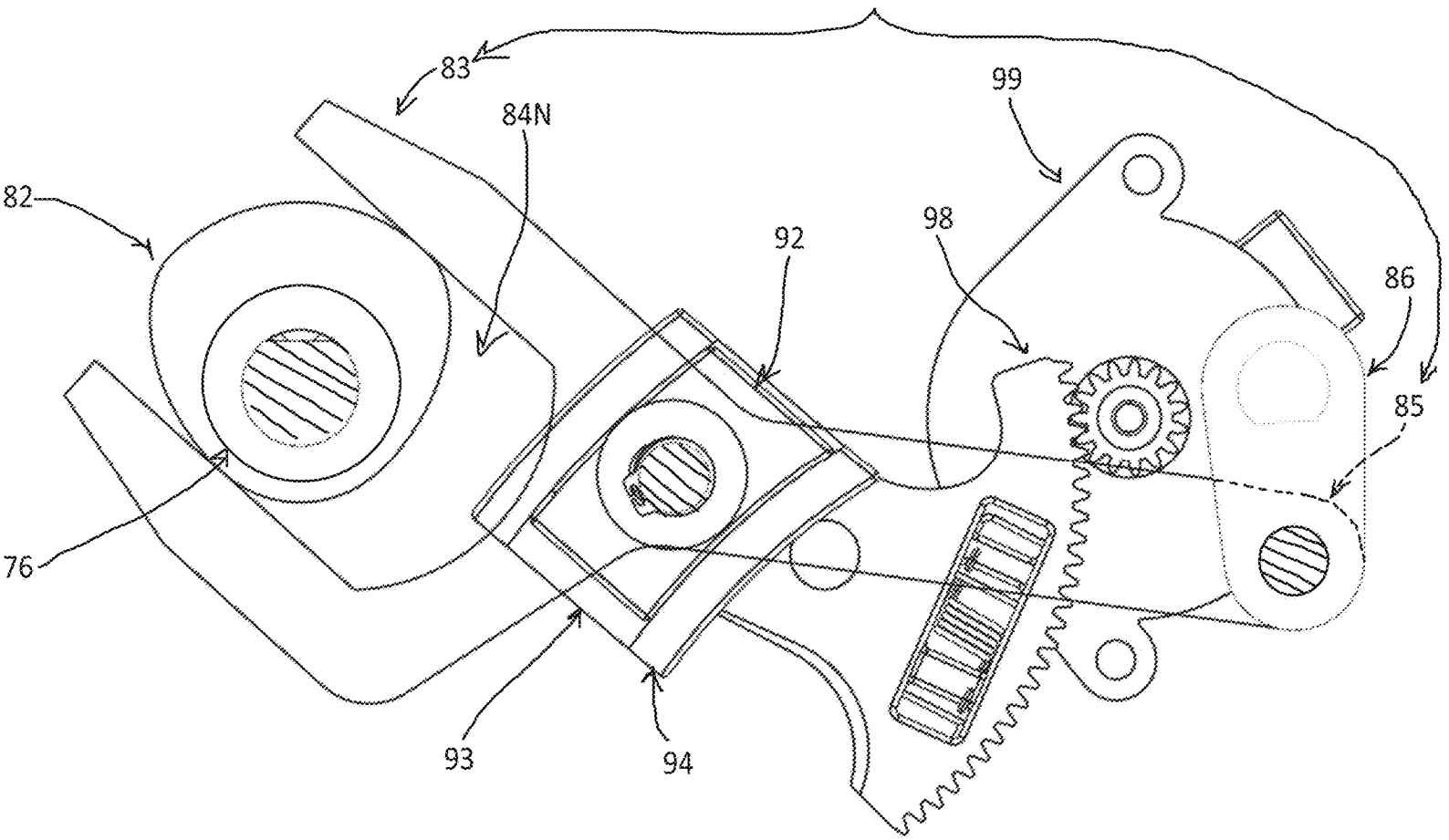
FIG. 14 is a view similar to FIG. 13 showing the motor has rotated the gear member to rotate the speed adjust member to change the orientation of slide direction of the slide member thereby adjusting the horizontal speed of the feed bar.

The cam link 84 has a first end 83 formed to include the cam notch 84N and a second end 85 spaced apart from the first end as shown in FIGS. 11, 13, and 14. The second end 85 is coupled to the horizontal swing arm 86. The slide member 92 is pinned to the cam link 84 between the first and second ends 83, 85 such that movement of the cam link 84 is restricted in the sliding direction of the slide member 92.

The horizontal swing arm 86 is pinned to second end 85 of the cam link 84 and to the horizontal rock shaft 88 as shown in FIGS. 10-11 and 13-14. The rock shaft crank 90 is pinned to the other end of the horizontal rock shaft 88 opposite the horizontal swing arm 86. The rock shaft crank 90 is pinned to the first horizontally-extending section 65 of the feed bar 68. The pinned connections allow the elements to rotate relative to one another about the respective axes.

The speed adjuster assembly 74 includes a slide member 92, a speed adjust member 94, an adjuster shaft 96, a gear member 98, and a motor 99 as shown in FIGS. 10-14. The slide member 92 is coupled to the cam link 84 with a pin 93 for movement therewith. The speed adjust member 94 defines a groove 95 that receives the slide member 92. The slide member 92 is configured to slide relative to the speed adjust member 94 within the groove 95 to restrict movement of the cam link 84 in the sliding direction of the slide member 92. The speed adjust member 94 is coupled to one end of the adjuster shaft 96 for rotation therewith. The gear member 98 is coupled to the other end of the adjuster shaft 96. The gear member 98 mates with the motor 99 to transfer rotation of the motor 99 to the adjuster shaft 96.

The adjuster shaft 96 and the motor 99 are supported by the frame base 22 of the sewing machine frame 12. The motor 99 may be mounted to the frame base 22. The adjuster shaft 96 may include bearings coupled to the frame base 22 to support the adjuster shaft 96 for rotation relative to the frame base 22.

A method of using the sewing machine assembly 10 may include several steps. The method may begin with the sewing machine assembly 10 in one of the free motion mode and the fixed motion mode. The user may desire to switch the sewing machine assembly 10 to the other mode.

To switch the sewing machine assembly 10 from the fixed motion mode to the free motion mode, the user may begin by removing the presser foot coupled to the presser bar 14 as suggested in FIG. 3. After the presser foot is removed, the user may change the feed dog cover 34 from the disengaged position to the engaged position as shown in FIG. 3.

The feed dog cover 34 may be changed to the engaged positon before a hopping foot is coupled to the presser bar 14. Once, the feed dog cover 34 is in the engaged position, the control unit 20 directs the feed dog drive system 32 to adjust the speed and/or position of the feed dog 30 so that the sewing machine assembly 10 is in the fixed motion mode.

To switch the sewing machine assembly 10 from the fixed motion mode to the free motion mode, the steps are repeated in reverse. The user may remove the feed dog cover 34 so that the feed dog cover 34 is in the disengaged position. Additionally, the user may remove the hopping foot from the presser bar 14 so that the presser foot may be coupled to the presser bar 14.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A sewing machine assembly comprising:

a sewing machine frame including a frame base, a frame body that extends from the frame base, a frame head coupled to the frame body that extends from the frame body toward the frame base to define a throat of the sewing machine frame;

a presser bar mounted to the frame head that extends from the frame head toward the frame base;

a feed dog assembly including:

a feed dog mounted to the frame base to reciprocate vertically and horizontally relative to the frame base to pull fabric between the pressure bar and the frame base through the sewing machine frame, a feed dog drive system coupled to the feed dog and configured to drive reciprocation of the feed dog relative to the frame base, and a feed dog cover configured to selectively change between a disengaged position in which the feed dog cover is spaced apart from the frame base to expose the feed dog to the fabric and an engaged position in which the feed dog cover is coupled to a surface of the frame base that faces the fabric so that the feed dog cover extends over the feed dog to shield the fabric from the feed dog; and a control unit coupled to the feed dog drive system and configured to direct the feed dog drive system to decrease a speed of the reciprocation of the feed dog when the feed dog cover is changed from the disengaged position to the engaged position so that the sewing machine assembly changes from a fixed motion mode to a free motion mode to allow a user to freely maneuver one of the sewing machine assembly and the fabric relative to the other.

2. The sewing machine assembly of claim 1, wherein the control unit includes:

a sensor coupled to the frame base configured to detect when the feed dog cover is in the engaged position; and a controller coupled to the sensor and configured to receive a signal from the sensor indicative of the feed dog cover being in the engaged position and direct the feed dog drive system to decrease the speed of the reciprocation of the feed dog in response to the signal.

3. The sewing machine assembly of claim 2, wherein the sensor is a manual button configured to change between a first position associated with the fixed motion mode of the sewing machine assembly and a second position associated with the free motion mode of the sewing machine assembly.

4. The sewing machine assembly of claim 3, wherein the feed dog cover includes:

a cover plate having a first side, a second side opposite the first side, and an outer edge that extends between and interconnects the first and second sides; and a sensor tab that extends from the first side of the cover plate so as to engage the manual button when the feed dog cover is in the engaged position to change the manual button from the first position to the second position.

5. The sewing machine assembly of claim 4, wherein the feed dog cover further includes:

a pair of locator tabs that extend from the first side of the cover plate and configured to be received in locator notches on the frame base when the feed dog cover is in the engaged position so as to align the sensor tab with the manual button.

6. The sewing machine assembly of claim 4, wherein the feed dog cover further includes:

at least one magnet coupled to the cover plate and configured to apply a magnetic force to the frame base to draw the cover plate to the frame base so that the feed dog cover remains coupled to the frame base when the feed dog cover is in the engaged position.

7. The sewing machine assembly of claim 2, wherein the sensor is an optical sensor.

8. The sewing machine assembly of claim 1, wherein the feed dog cover includes:

a cover plate having a first side, a second side opposite the first side, and an outer edge that extends between and interconnects the first and second sides; and at least one locator tab that extends from the first side of the cover plate and configured to be received in a locator notch on the frame base when the feed dog cover is in the engaged position.

9. The sewing machine assembly of claim 8, wherein the feed dog cover further includes:

at least one magnet coupled to the cover plate and configured to apply a magnetic force to the frame base to draw the cover plate to the frame base so that the feed dog cover remains coupled to the frame base when the feed dog cover is in the engaged position.

10. The sewing machine assembly of claim 8, wherein the cover plate of the feed dog cover is formed to include a cavity that extends into the first side of the cover plate and the cavity receives the feed dog when the feed dog cover is in the engaged position.

11. The sewing machine assembly of claim 1, wherein the control unit is configured to direct the feed dog drive system to lower a peak vertical position of the feed dog as the feed dog reciprocates vertically and horizontally relative to the sewing machine frame when the feed dog cover is changed from the disengaged position to the engaged position so that the feed dog is retracted below an outer surface of the frame base as the feed dog vertically and horizontally reciprocates relative to the sewing machine frame.

12. A sewing machine assembly comprising:

a sewing machine frame;

a feed dog assembly including:

a feed dog mounted to the sewing machine frame to reciprocate vertically and horizontally relative to the sewing machine frame;

a feed dog drive system coupled to the feed dog and configured to drive reciprocation of the feed dog relative to the frame base, and a feed dog cover configured to selectively change between a disengaged position in which the feed dog cover is spaced apart from the sewing machine frame to expose the feed dog to fabric being sewn and an engaged position in which the feed dog cover is coupled to a surface of the frame base that faces the fabric so that the feed dog cover extends over the feed dog to shield the fabric from the feed dog, and a control unit coupled to the feed dog drive system and configured to direct the feed dog drive system to decrease a speed of the reciprocation of the feed dog and to lower a peak vertical position of the feed dog when the feed dog cover is changed from the disengaged position to the engaged position so that the sewing machine assembly changes from a fixed motion mode to a free motion mode to allow a user to freely maneuver one of the sewing machine assembly and the fabric relative to the other.

13. The sewing machine assembly of claim 12, wherein the control unit includes:

a sensor coupled to the sewing machine frame configured to detect when the feed dog cover is in the engaged position; and a controller coupled to the sensor and configured to receive a signal from the sensor indicative of the feed dog cover being in the engaged position and direct the feed dog drive system to decrease the speed of the reciprocation of the feed dog in response to the signal.

14. The sewing machine assembly of claim 13, wherein the sensor is a manual button configured to change between a first position associated with the fixed motion mode of the sewing machine assembly and a second position associated with the free motion mode of the sewing machine assembly.

15. The sewing machine assembly of claim 13, wherein the feed dog cover includes:

a cover plate having a first side, a second side opposite the first side, and an outer edge that extends between and interconnects the first and second sides; and a sensor tab that extends from the first side of the cover so as to engage the sensor when the feed dog cover is in the engaged position.

16. The sewing machine assembly of claim 15, wherein the feed dog cover further includes:

a pair of locator tabs that extend from the first side of the cover plate and configured to be received in locator notches on the sewing machine frame when the feed dog cover is in the engaged position so as to align the sensor tab with the manual button.

17. The sewing machine assembly of claim 15, wherein the feed dog cover further includes:

at least one magnet coupled to the cover plate and configured to apply a magnetic force to the sewing machine frame to draw the cover plate to the sewing machine frame so that the feed dog cover remains coupled to the sewing machine frame when the feed dog cover is in the engaged position.

18. The sewing machine assembly of claim 15, wherein the cover plate of the feed dog cover is formed to include a cavity that extends into the first side of the cover plate that receives the feed dog.

19. The sewing machine assembly of claim 12, wherein the feed dog cover includes:

a cover plate having a first side, a second side opposite the first side, and an outer edge that extends between and interconnects the first and second sides;

at least one locator tab that extends from the first side of the cover plate and configured to be received in a locator notch on the sewing machine frame when the feed dog cover is in the engaged position; and at least one magnet coupled to the cover plate and configured to apply a magnetic force to the sewing machine frame to draw the cover plate to the sewing machine frame so that the feed dog cover remains coupled to the sewing machine frame when the feed dog cover is in the engaged position.

20. A method comprising providing a sewing machine assembly comprising:

a sewing machine frame;

a presser bar mounted to the sewing machine frame;

a feed dog assembly including:

a feed dog mounted to the sewing machine frame to reciprocate horizontally relative to the sewing machine frame, a feed dog drive system configured to drive reciprocation of the feed dog relative to the frame base, and a feed dog cover configured to selectively change between a disengaged position in which the feed dog cover is spaced apart from the sewing machine frame to expose the feed dog to fabric being sewn and an engaged position in which the feed dog cover is coupled to a surface of the frame base that faces the fabric so that the feed dog cover extends over the feed dog to shield the fabric from the feed dog providing a pressure foot;

attaching the presser foot to the presser bar;

locating the feed dog cover in the disengaged position to cause the sewing machine assembly to be in the fixed motion mode so that the feed dog pulls the fabric between the presser foot and the feed dog through the sewing machine while a user sews the fabric;

removing the presser foot from the presser bar;

coupling a hopping foot to the presser bar; and locating the feed dog cover in the engaged position to cause the sewing machine assembly to be in the free motion mode so that the fabric between the presser foot and the feed dog is shielded from the feed dog while the user sews the fabric.

* * * * *